US010843319B2

(12) United States Patent
Chen et al.

(10) Patent No.: US 10,843,319 B2
(45) Date of Patent: Nov. 24, 2020

(54) POSITIONING STRUCTURE OF STAPLER HANDLE

(71) Applicant: APEX MFG. CO., LTD., Taichung (TW)

(72) Inventors: Chia-Tse Chen, Taichung (TW); Pei-Hung Cheng, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 113 days.

(21) Appl. No.: 16/225,746

(22) Filed: Dec. 19, 2018

(65) Prior Publication Data

US 2020/0198109 A1 Jun. 25, 2020

(51) Int. Cl.

| | |
|---|---|
| ***B25C 5/00*** | (2006.01) |
| ***B25G 3/00*** | (2006.01) |
| ***B25C 5/06*** | (2006.01) |
| *B25G 3/12* | (2006.01) |
| *B25C 5/11* | (2006.01) |

(52) U.S. Cl.
CPC ..... *B25C 5/06* (2013.01); *B25C 5/11* (2013.01); *B25G 3/12* (2013.01)

(58) Field of Classification Search
CPC ..... B25C 5/06; B25C 5/11; B25G 3/12
USPC ..... 227/120
See application file for complete search history.

(56) References Cited

U.S. PATENT DOCUMENTS

| | | | | |
|---|---|---|---|---|
| 2,710,964 | A * | 6/1955 | Spencer | B25C 5/10 227/132 |
| 8,074,854 | B2 * | 12/2011 | Hu | B25C 5/11 227/130 |
| 8,118,205 | B2 * | 2/2012 | Popowich | B25C 5/11 173/1 |
| 2002/0108996 | A1 * | 8/2002 | Cornett | B25C 5/06 227/132 |
| 2015/0041516 | A1 * | 2/2015 | Chen | B25C 5/11 227/107 |
| 2017/0266798 | A1 * | 9/2017 | Wang | B25C 5/11 |
| 2017/0266799 | A1 * | 9/2017 | Wang | B25C 5/11 |
| 2018/0215025 | A1 * | 8/2018 | Marks | B25C 5/06 |

* cited by examiner

*Primary Examiner* — Andrew M Tecco
*Assistant Examiner* — Eyamindae C Jallow
(74) *Attorney, Agent, or Firm* — Muncy, Geissler, Olds & Lowe, P.C.

(57) ABSTRACT

A positioning structure of stapler handle includes a buckle assembly and a buckle member. The buckle assembly includes a first coupling portion and a pushing unit connected together. The buckle member includes a first second coupling portion and a pushed unit connected together. The first coupling portion is adapted for being coupled with the second coupling portion. The pushed unit is located at the movement path of the buckle assembly.

9 Claims, 12 Drawing Sheets

POSITIONING STRUCTURE OF STAPLER HANDLE

BACKGROUND OF THE INVENTION

Field of the Invention

The present invention relates to a stapler, more especially to a positioning structure of stapler handle.

Description of the Prior Art

Stapler is a common tool in upholstery. To prevent from accidentally pressing, positioning structures are designed for positioning the handle, as disclosed in patents TW M397888, TW I 311516, and TW 482072.

As shown in the patents previously mentioned, the conventional positioning structure includes a buckle. The handle is positioned by pivoting the buckle to make it vertical to hold the handle. However, fi the user wants to use the stapler, the handle has to be released by two hands (holding the handle by one hand, and pivoting the buckle by the other hand).

Other positioning structures include too many elements to have complicated structure. As a result, the cost is high, and the efficiency of manufacture is low. In addition, malfunction often happens.

SUMMARY OF THE INVENTION

The main object of the present invention is to provide a positioning structure of stapler handle to hold the handle firmly. In addition, the handle can be released with one hand.

To achieve the above and other objects, the positioning structure of stapler handle of the present invention adapted for a stapler including a main body and a handle pivotally connected to the main body includes a buckle assembly and a buckle member.

The buckle assembly is adapted for being disposed on the handle and movable along a movement path. The buckle assembly includes a first coupling portion and a pushing unit. The buckle member is disposed on the main body and movable between a release position and a locking position. The buckle member includes a second coupling portion and a pushed unit connected together. When the buckle member is located at the locking position, the first coupling portion and the second coupling portion are releasably coupled with each other, and the pushed unit is on the movement path of the buckle assembly. When the buckle assembly moves toward the pushed unit along the movement path, the pushing unit pushes the pushed unit to make the buckle member move toward the release position so that the first coupling portion is released from the second coupling portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
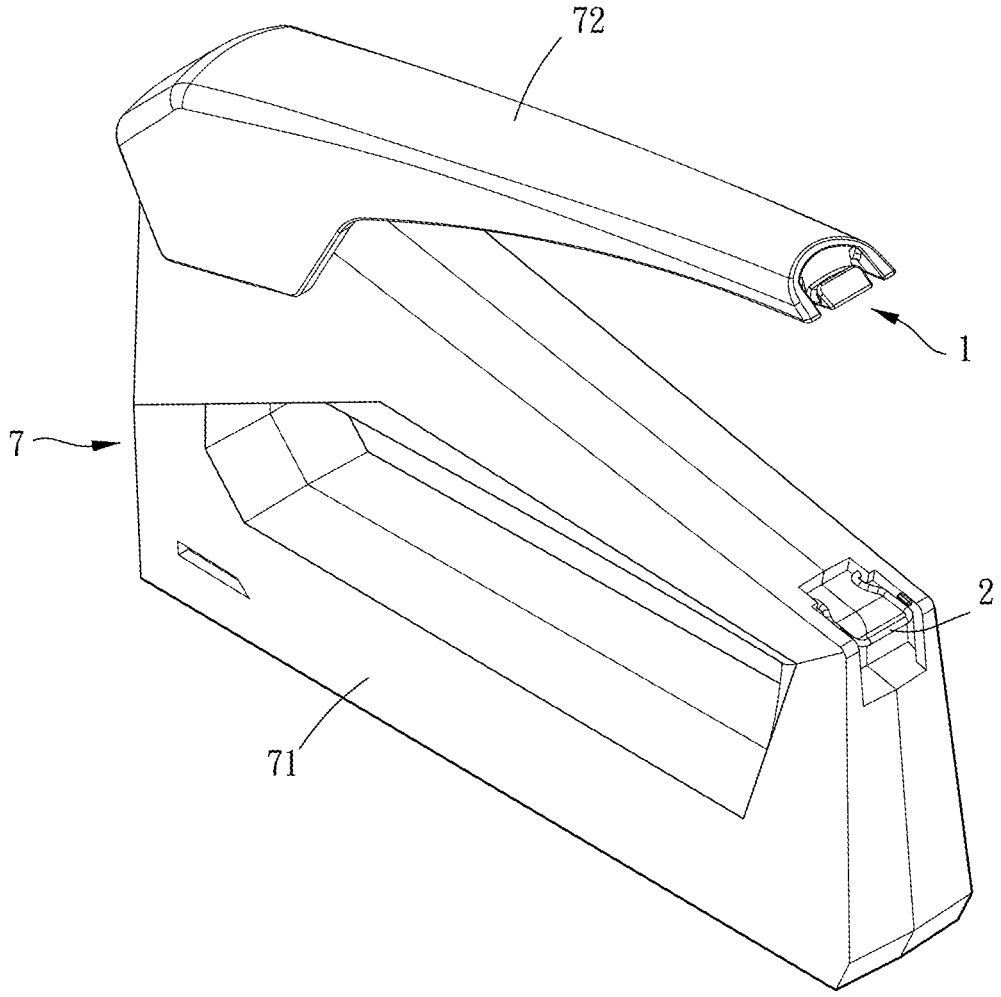
FIG. 1 is a stereogram of the present invention.
Figure 2:
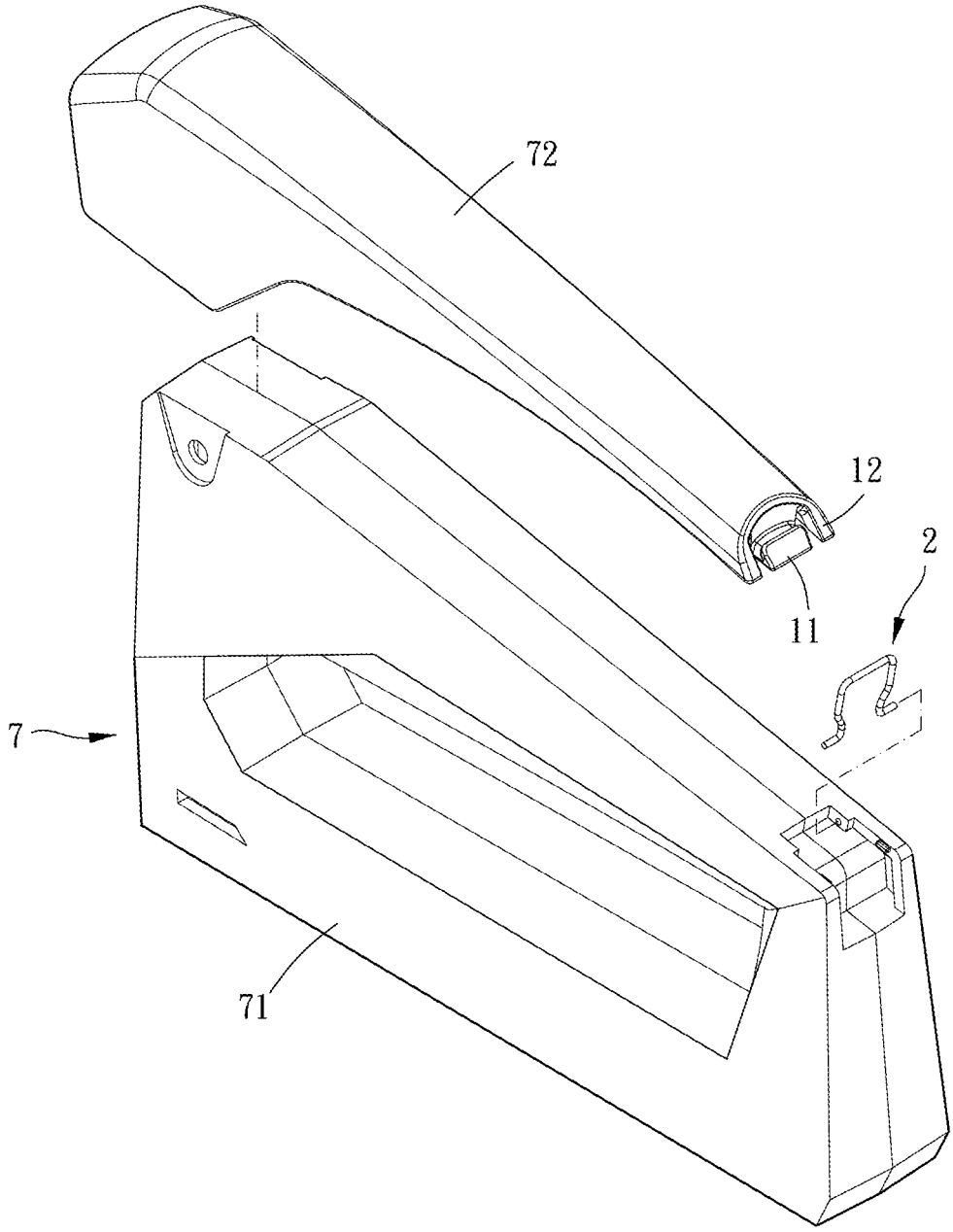
FIG. 2 is a breakdown drawing of FIG. 1.
Figure 3:
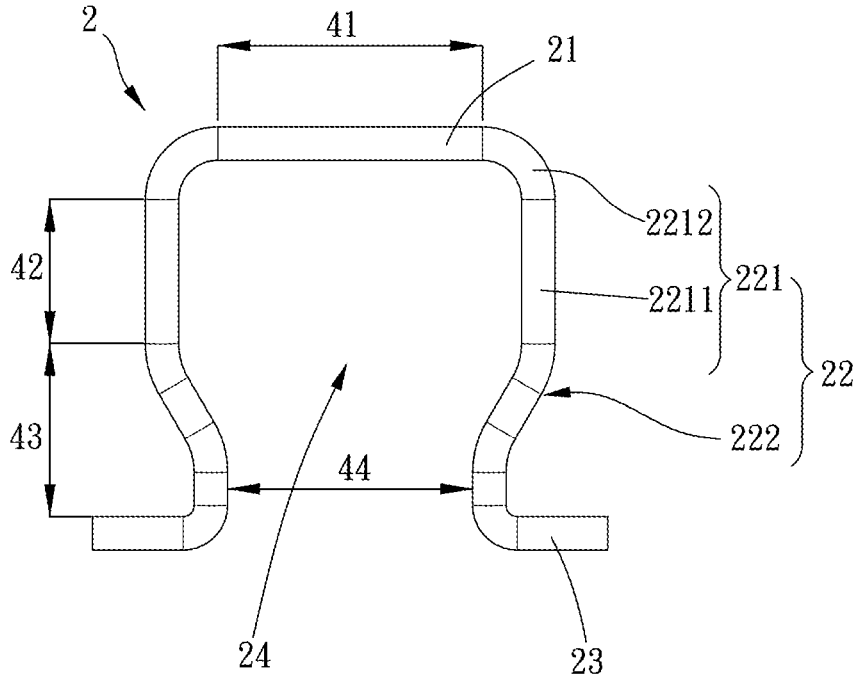
FIG. 3 is an illustration showing a buckle member of the present invention.
Figure 4:
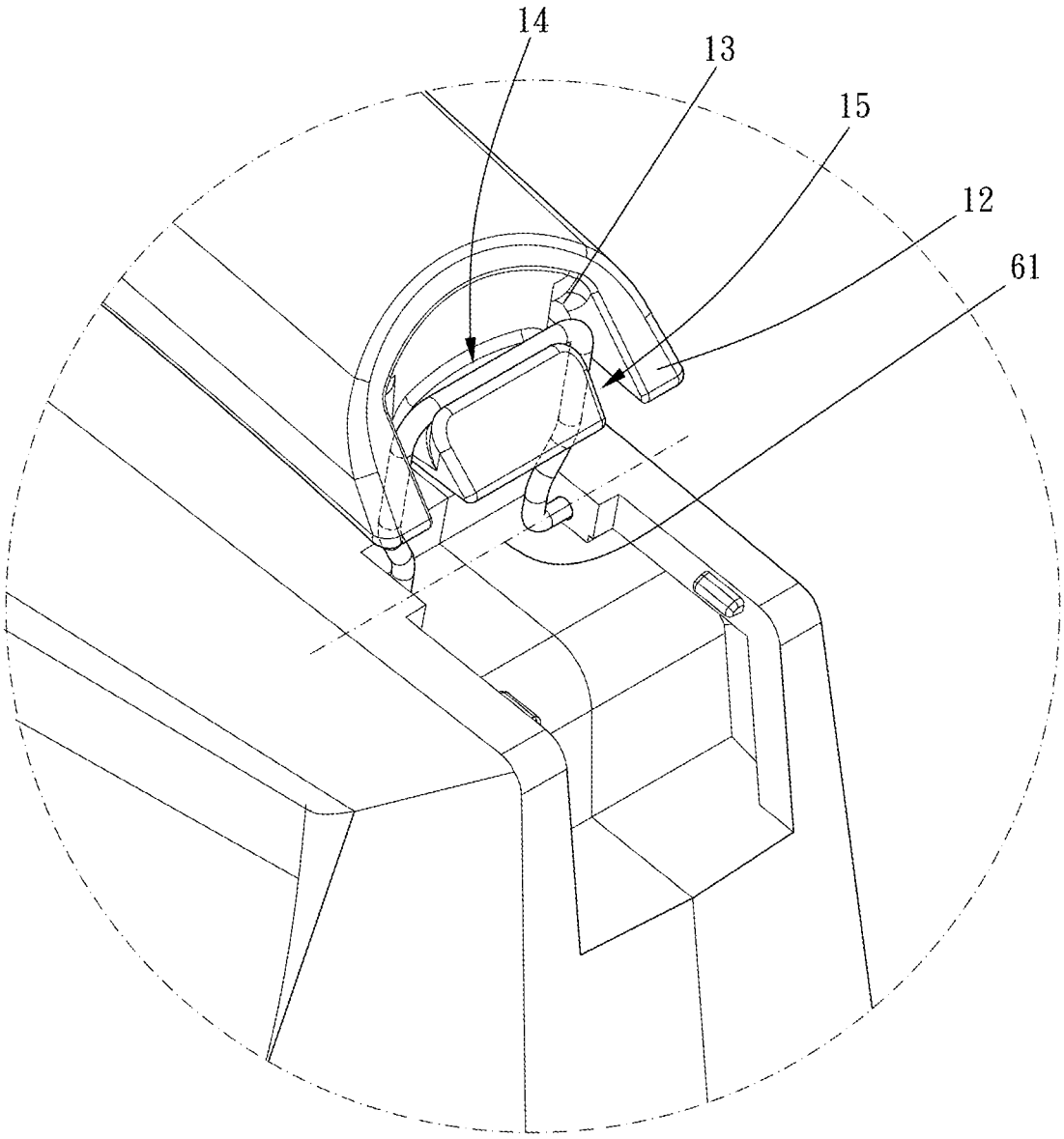
FIG. 4 is an illustration showing a buckle member coupled with a buckle assembly of the present invention.
Figure 5:
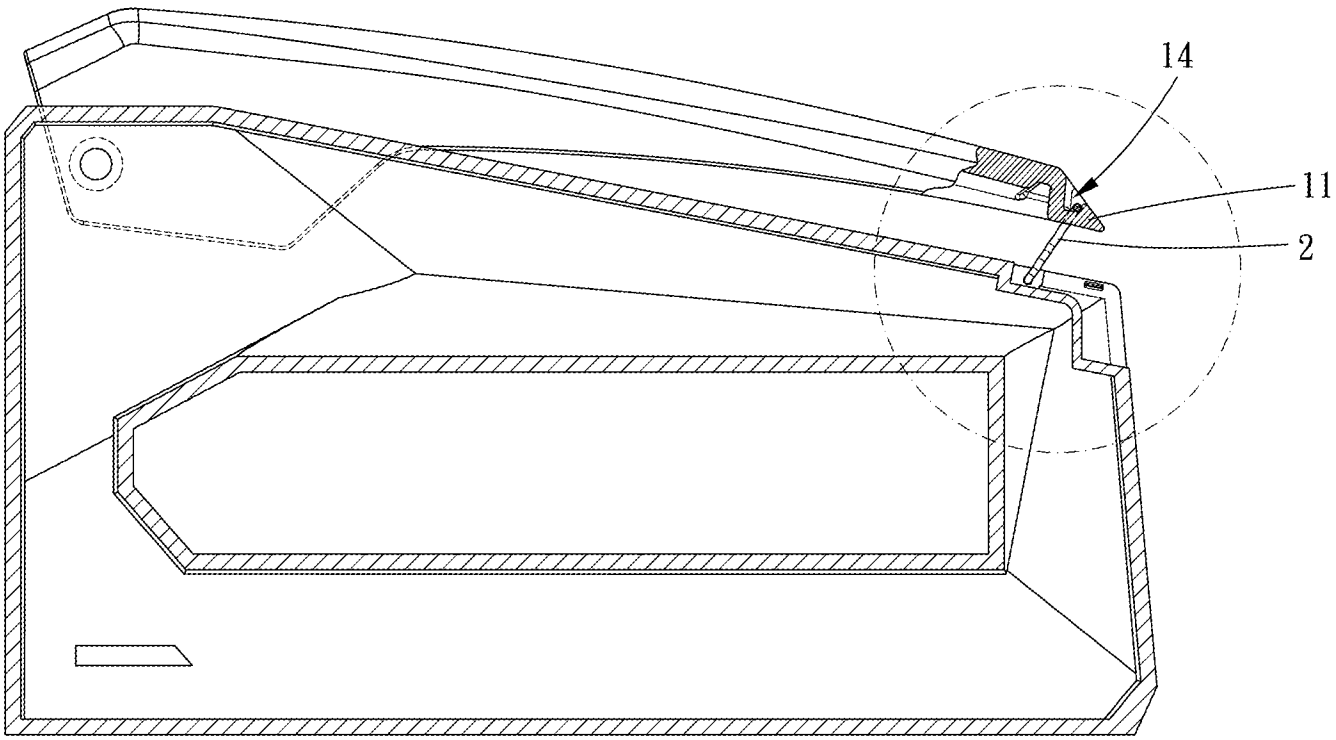
FIG. 5 is a lateral view of a buckle member of the present invention at a locking position.
Figure 6:
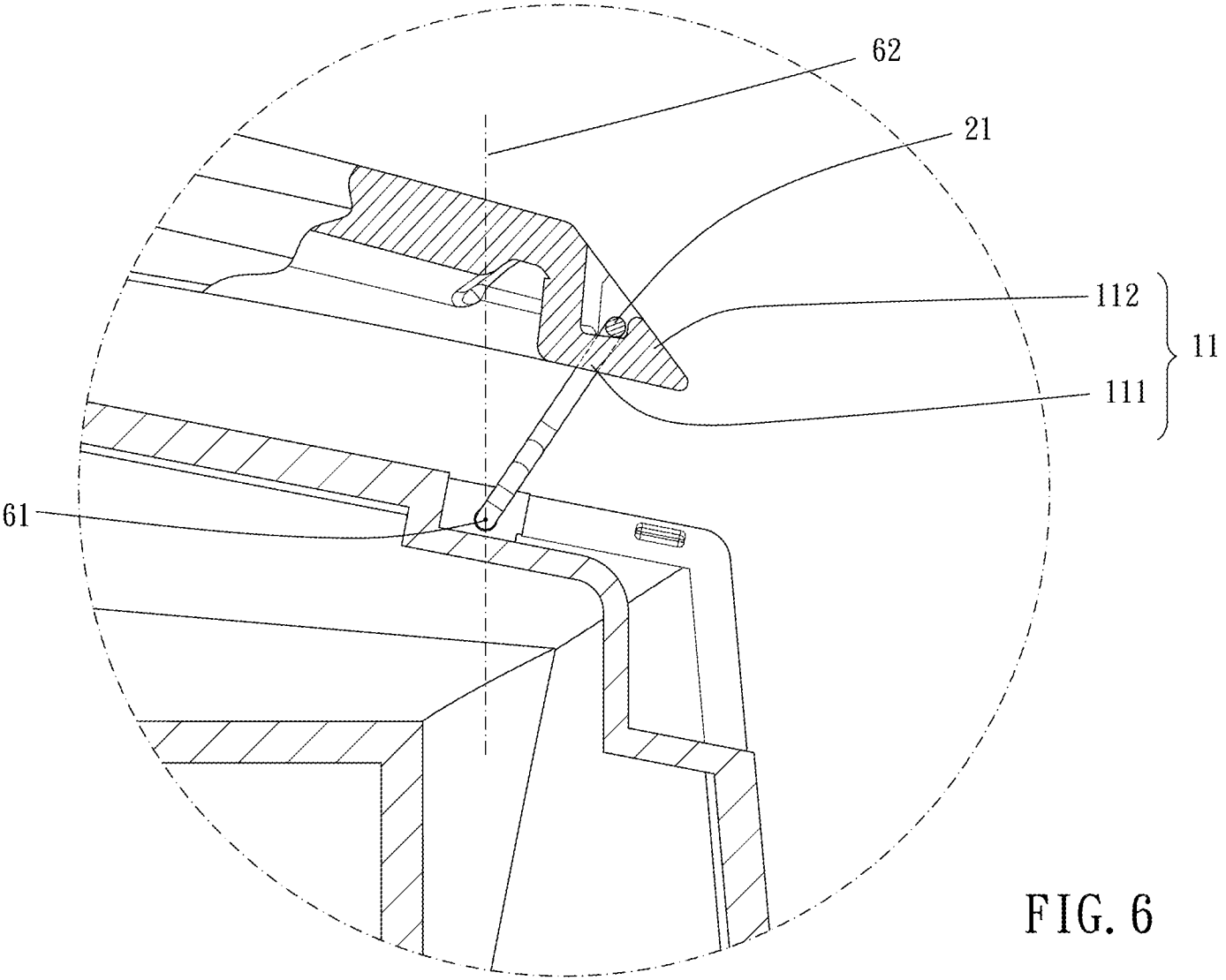
FIG. 6 is a partial enlargement of FIG. 5.
Figure 7:
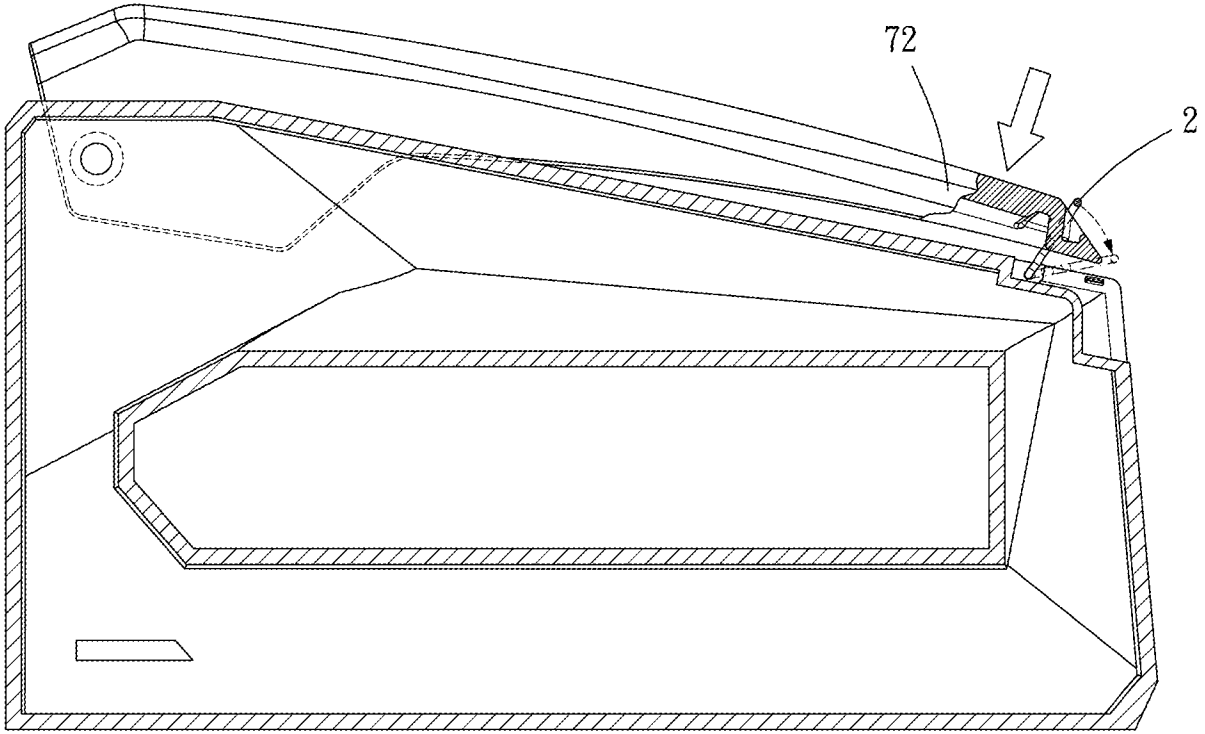
FIG. 7 is a lateral view of a buckle member of the present invention at a release position.
Figure 8:
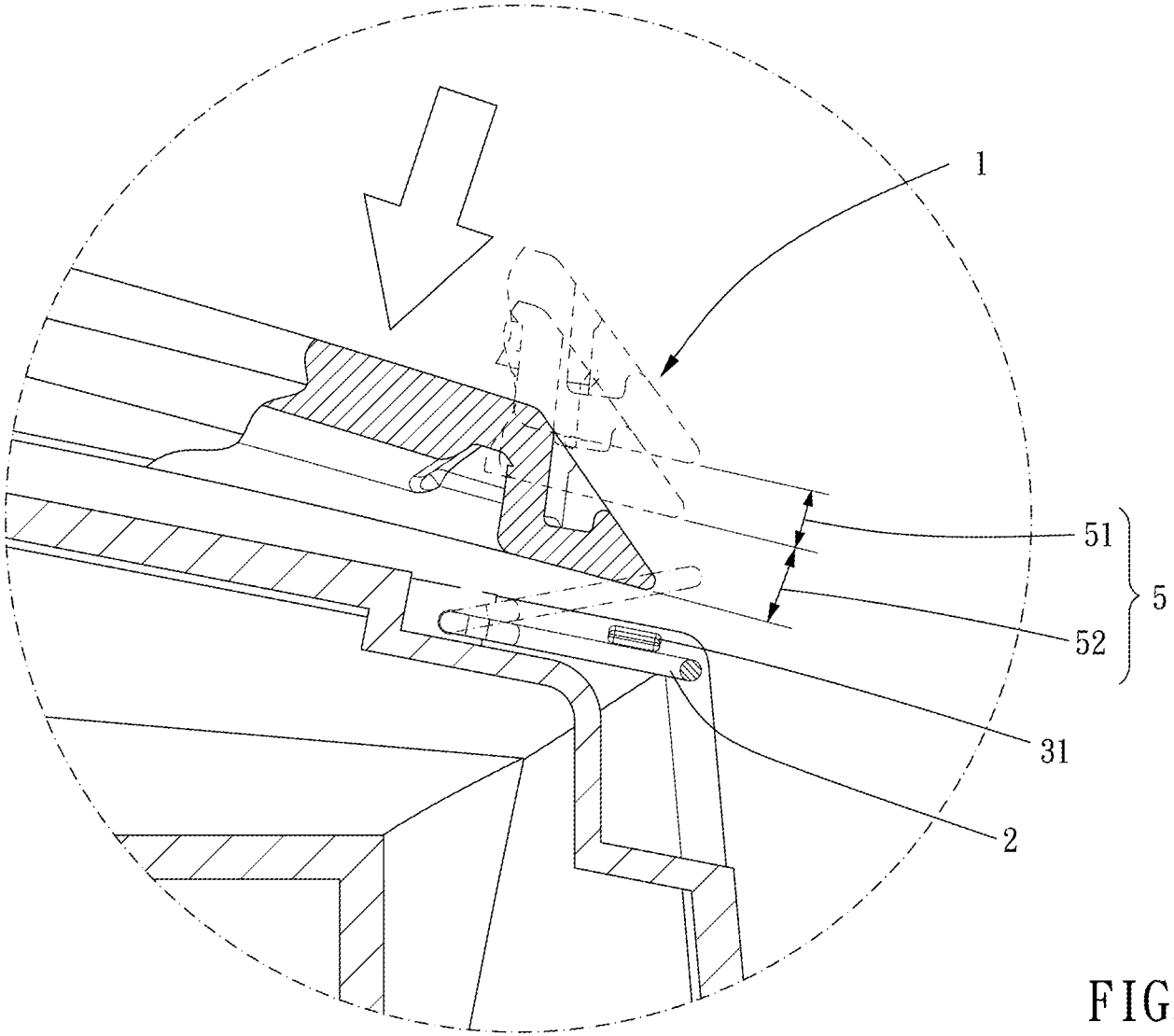
FIG. 8 is an illustration showing the movement of the buckle assembly of the present invention.
Figure 9:
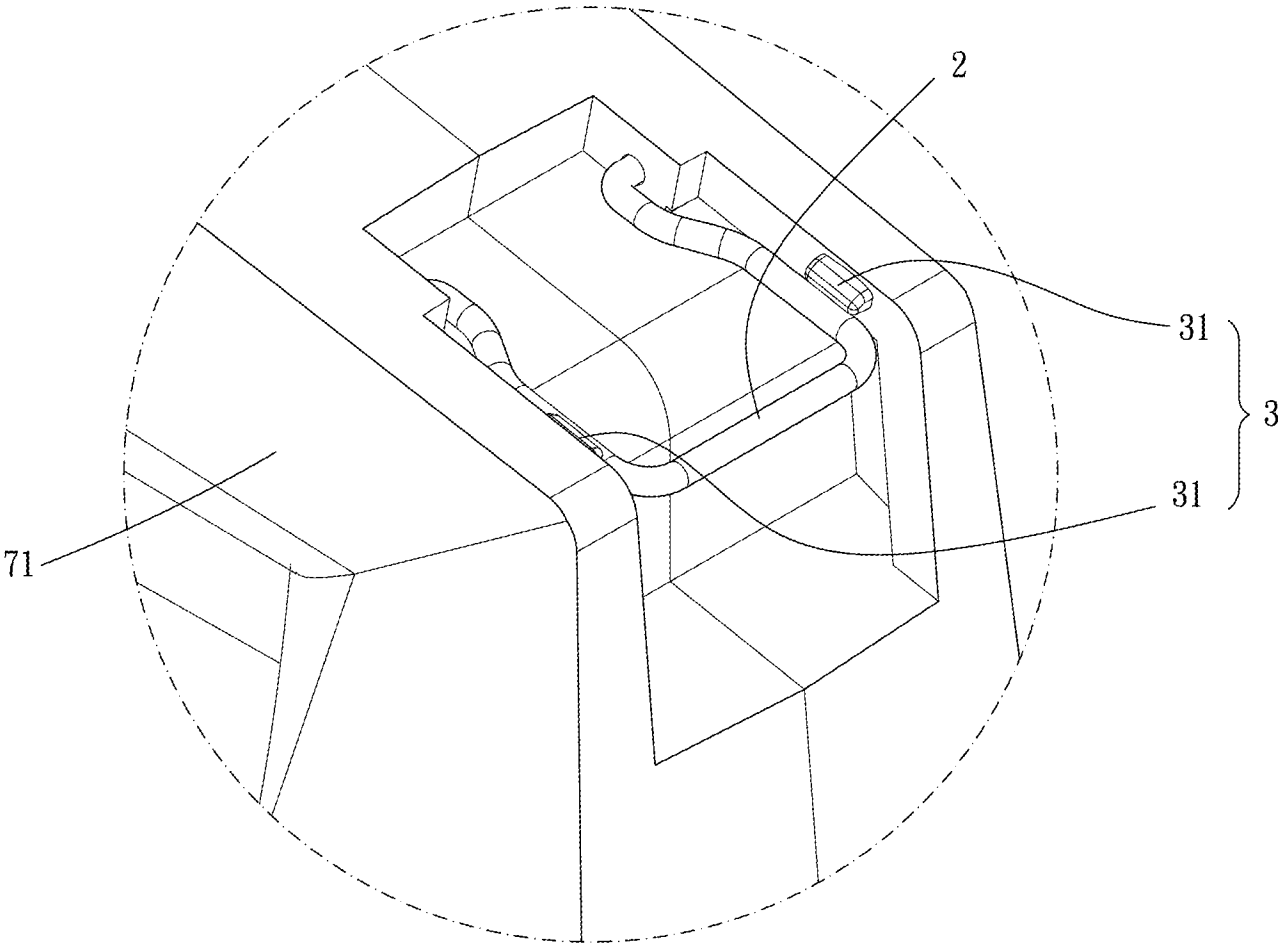
FIG. 9 is a partial stereogram showing a buckle member positioned on a main body of the present invention.
Figure 11:
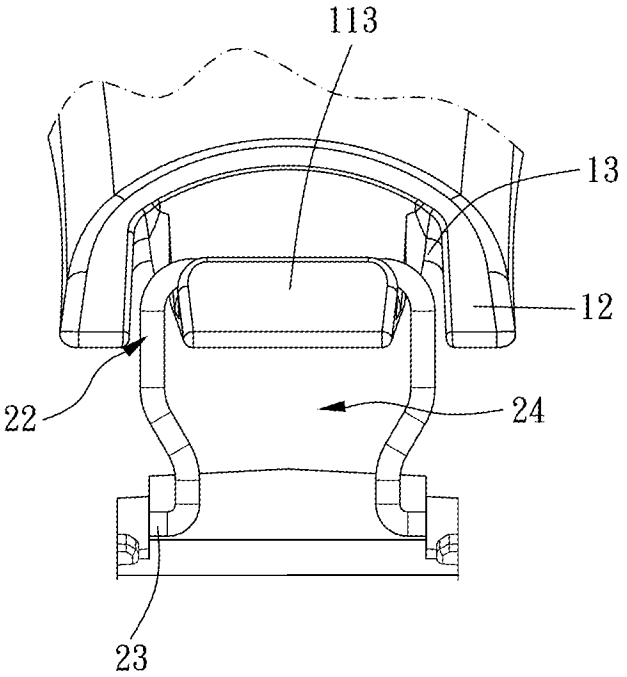
FIG. 11 is an illustration of FIG. 10 at an other angle.
Figure 10:
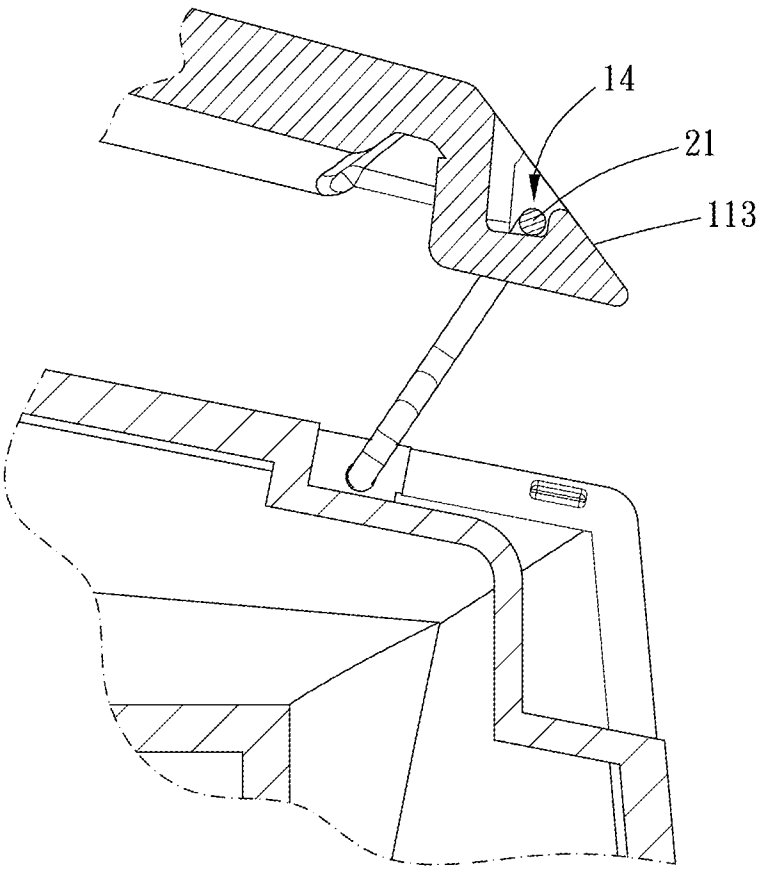
FIG. 10 is a lateral enlargement of a buckle member of the present invention at a locking position.
Figure 13:
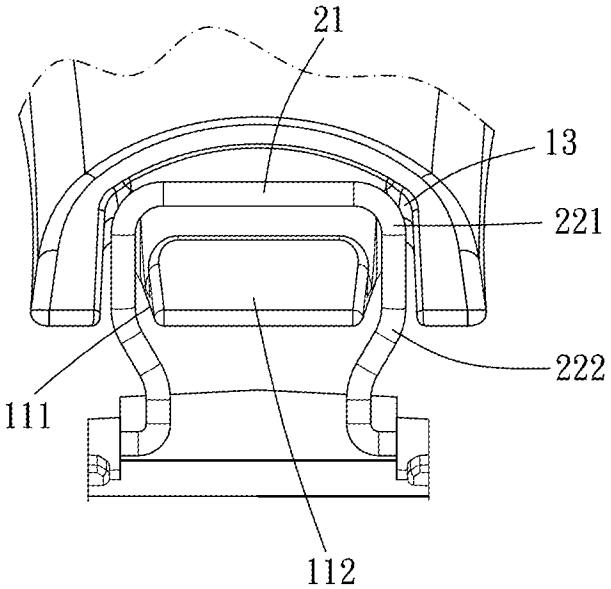
FIG. 13 is an illustration of FIG. 12 at an other angle.
Figure 12:
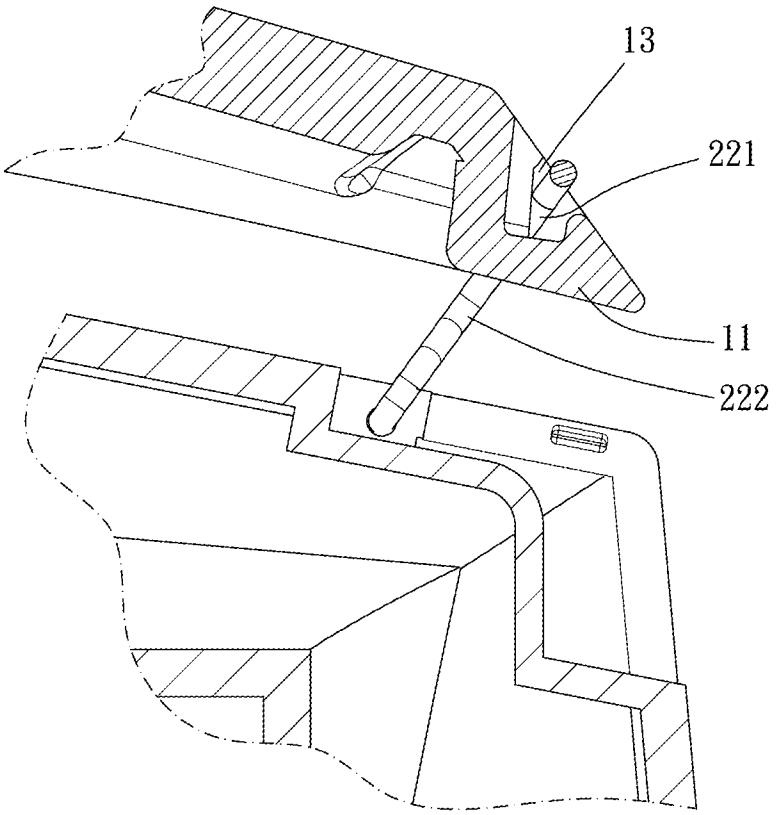
FIG. 12 is a lateral enlargement showing a connection portion pushing a body portion at a first section.
Figure 15:
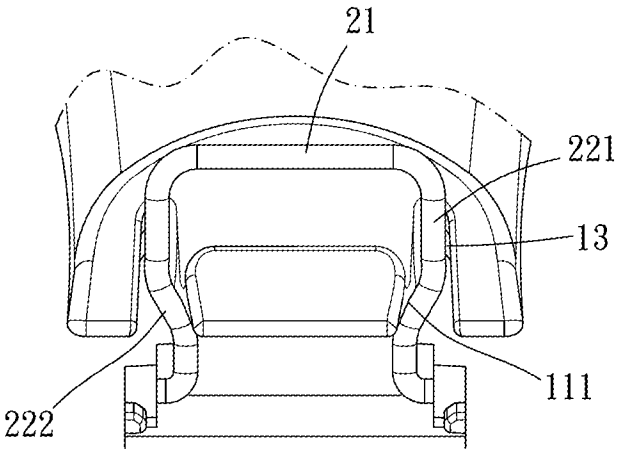
FIG. 15 is an illustration of FIG. 14 at an other angle.
Figure 14:
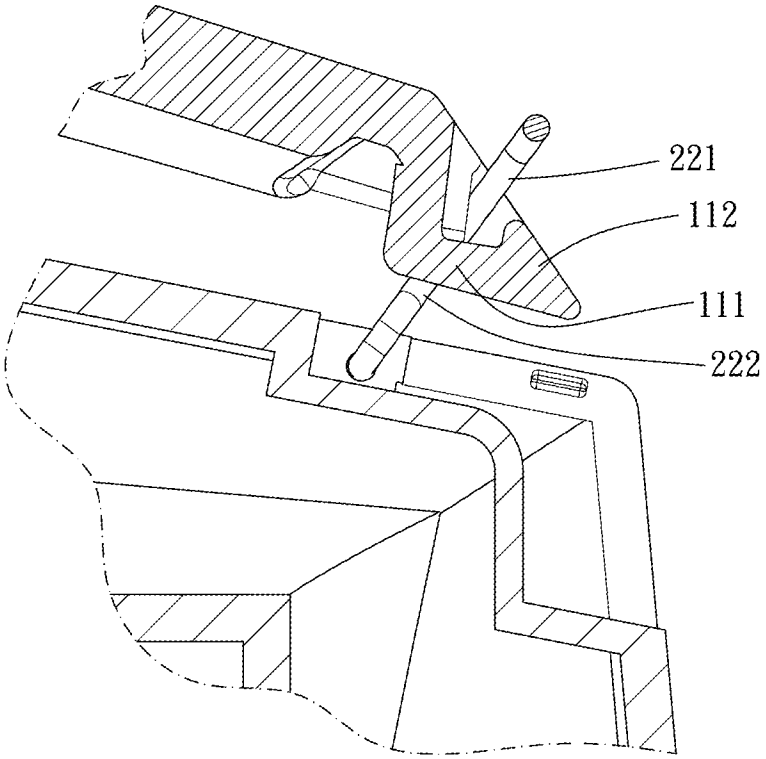
FIG. 14 is a lateral enlargement showing a base portion pushing a head portion at a second section.

Please refer to FIG. 1 to FIG. 15, the positioning structure of stapler handle of the present invention is adapted for a stapler 7 including a main body 71 and a handle 72 which is pivotally connected to the main body 71. The positioning structure of stapler handle includes a buckle assembly 1 and a buckle member 2.

The buckle assembly 1 is adapted for being disposed on the handle 72 and movable along a movement path 5. The buckle assembly 1 includes a first coupling portion 11 and a pushing unit. The buckle member 2 is disposed on the main body 71 and movable between a release position and a locking position. The buckle member 2 includes a second coupling portion 21 and a pushed unit connected together. When the buckle member 2 is located at the locking position, the first coupling portion 11 and the second coupling portion 21 are releasably coupled with each other, and the pushed unit is on the movement path 5 of the buckle assembly 1. When the buckle assembly 1 moves toward the pushed unit along the movement path 5, the pushing unit pushes the pushed unit to make the buckle member 2 move toward the release position so that the first coupling portion 11 is released from the second coupling portion 21.

That is, because the pushed unit of the buckle member 2 is located at the movement path 5 of the pushing unit of the buckle assembly 1, the user can release the buckle member 2 from the buckle assembly 1 easily by pressing the handle 72 with one hand in order to release the handle 72. Thus, the user can use the other hand to hold or press other objects.

Specifically, the buckle member 2 encloses a restriction space 24. When the buckle member 2 is located at the locking position, the buckle assembly 1 penetrates the restriction space 24 to move along the movement path 5. In other words, the handle 72 can pivot only in the restriction space 24 so that the handle 72 can be positioned.

More specifically, the first coupling portion 11 includes a base portion 111 and a buckle portion 112. The base portion 111 is adapted for connecting with the handle 72. The buckle portion 112 is connected to the base portion 111 to define a positioning groove 114 with the base portion 111. At least one pivot portion 23 of the buckle member 2 is adapted for rotatably connected to the main body 71 so that the second coupling portion 21 can selectively swing into the positioning groove 14 to couple with the buckle portion 112 one the movement path 5 for quick coupling. Preferably, the first coupling portion 11 is hook-shaped to enhance the connection between the first coupling portion 11 and the second coupling portion 21.

Preferably, the buckle assembly 1 further includes two stopping arms 12 spacedly arranged at two opposite sides of the first coupling portion 11 to define two sliding channels 15. The buckle member 2 further includes two pivot arms 22 connected to the second coupling portion 21 and the at least one pivot portion 23 respectively. The two pivot arms 22 can selectively swing at the two sliding channels 15. When the buckle member 2 is located at the locking position, the two stopping arms 12 can prevent other objects from contacting the buckle member 2 so that the buckle member 2 can position the handle 72 firmly. In the present embodiment, the at least one pivot portion 23 includes two said pivot portions 23. The two pivot portions 23 are adapted for rotatably inserting into the main body 71 for quick coupling or releasing.

The buckle member 2 is adapted for being pivotally connected to the main body 71 and rotatable about an axis 61. When observing along an extension direction of the axis 61, a standard line 62 is defined perpendicular to the horizontal plane to pass through the axis 61. When the buckle member 2 is located at the locking position, the connection between the first coupling portion 11 and the second coupling portion 21 is preferably located at the right side of the standard line 62. Thereby, when the handle 72 is pressed to make the buckle assembly 1 move along the movement path 5, the buckle member 2 rotates rightward due to weight itself to facilitate releasing of the second coupling portion 21 from the first coupling portion 11. In the present embodiment, an angle of pivoting of the buckle member 2 between the release position and the locking position is smaller than 90 degrees.

About the process of the buckle member 2 releasing the buckle assembly 1, the buckle assembly 1 further includes two connection portions 13 connected to the two stopping arms 12 and the first coupling portion 11 respectively. The movement path 5 includes a first section 51. When the buckle assembly 1 moves toward the release position from the locking position along the first section 51, the two body portions 221 of the two pivot arms 22 are located at the movement path of the two connection portions 13. The two connection portions 13 push the two body portions 221 to drive the at least one pivot portion 23 to rotate with respect to the main body 71.

More specifically, the two pivot arms 22 further include two head portions 222 bending toward each other. The two head portions 222 are connected to the two body portions 221 respectively. The movement path 5 further include a second section 51 connected to the first section 51. When the buckle assembly 1 moves into the second section 52 from the first section 51, the two head portions 222 are located at the movement path 5 of the base portion 111. The base portion 111 pushes the two head portions 222 to drive the at least one pivot portion 23 to rotate with respect to the main body 71 continuously.

In the present embodiment, the pushing unit includes the two connection portions 13 and the base portion 111, and the pushed unit includes the two body portions 221 and the head portions 222. When the handle 72 is pressed to drive the buckle assembly 1 to move along the movement path 5, two-stage operation occurs. First, the two connection portions 13 push the two body portions 221. Second, the base portion 111 pushes the two head portions 222. Because the two head portions 222 are closer to the position of connection between the buckle member 2 and the main body 71, the second coupling portion 21 can swing more even if the two head portions 22 swings little. Thus, at the second stage of pushing, the second coupling portion 21 may pass through the buckle portion 112 quickly to release the first coupling portion 11.

Preferably, the buckle portion 112 has an inclined face 113 at a side thereof opposite to the base portion 111. The second coupling portion 21 is selectively slidable along the inclined face 113. Specifically, when the second coupling portion 21 moves to abut against the inclined face 113, the inclined face 113 helps the second coupling portion 21 slide smoothly during the process of locking or releasing.

Besides, the positioning structure of stapler handle further includes a positioning assembly 3 adapted for connecting to the main body 71. When the second coupling portion 21 is released from the first coupling portion 11, the buckle member 2 is selectively coupled with the positioning assembly 3 so that the buckle member 2 can be firmly positioned. In the present embodiment, the positioning assembly 3 includes two protrusions 31 facing each other and arranged spacedly. The two protrusions 31 selectively block the buckle member 2 interferentially.

Preferably, the buckle member 2 is integrally formed by a bent rod to have stronger structure and longer service life.

Specifically, the second coupling portion 21 is a straight rod. A first length 41 is defined as a length of the second coupling portion 21. Each of the body portions 221 includes a straight section 2211 and a bending section 2212 connected together. The straight section 2211 is connected to the head portion 222, and the bending section 2212 is connected to the second coupling portion 21. A second length 42 is defined as a length of the straight section 2211. A third length 43 is defined as a length of each of the head portions 222 along a direction perpendicular to the axis 61. The first length 41 is larger than each of the second length 42 and the third length 43, and the second length 42 is smaller than each of the first length 41 and the third length 43. A ratio of the first length 41 to the second length 42 is ranged 1.6-2.1. A ratio of the first length 41 to the third length 43 is ranged 1.3-1.7. Furthermore, a fourth length 44 is defined as a minimum distance between the two head portions 222. The fourth length 44 is smaller than the first length 41. A width of the base portion 111 is smaller than the first length 41 but larger than the fourth length 44 so that the base portion 111 can push the two head portions 222 better at the second stage of pushing.

In conclusion, because of the arrangement of the pushing unit of the buckle assembly with respect to the pushed unit of the buckle member along the movement path, the first coupling portion and the second coupling portion can be quickly released by pressing the handle.

What is claimed is:

1. A positioning structure of stapler handle, adapted for a stapler including a main body and a handle pivotally connected to the main body, the positioning structure of stapler handle including:

a buckle assembly, adapted for being disposed on the handle and movable along a movement path, the buckle assembly including a first coupling portion and a pushing unit;

a buckle member, disposed on the main body and movable between a release position and a locking position, the buckle member including a second coupling portion and a pushed unit connected together;

wherein when the buckle member is located at the locking position, the first coupling portion and the second coupling portion are releasably coupled with each other, the pushed unit is on the movement path of the buckle assembly, wherein the first coupling portion includes a base portion and a buckle portion, the base portion is adapted for being connected to the handle, the buckle portion is connected to the base portion to enclose a positioning groove with the base portion, at least one pivot portion of the buckle member is adapted for being rotatably connected to the main body so that the second coupling portion is selectively swingable into the positioning groove to be coupled with the buckle portion on the movement path:

wherein the buckle assembly further includes two stopping arms, the two stopping arms are spacedly arranged at two opposite sides of the first coupling portion to define two sliding channels; the buckle member further includes two pivot arms, the two pivot arms are connected to the second coupling portion and the at least one pivot portion respectively, the two pivot arms are selectively swingable at the two sliding channels.

2. The positioning structure of stapler handle of claim 1, wherein when the buckle assembly moves toward the pushed unit along the movement path, the pushing unit pushes the pushed unit to make the buckle member move toward the release position so that the first coupling portion is released from the second coupling portion.

3. The positioning structure of stapler handle of claim 1, wherein the buckle member is adapted for being pivotally connected to the main body and is rotatable about an axis; when observing along an extension direction of the axis, a standard line is defined perpendicular to a horizontal plane and passes through the axis; when the buckle member is located at the locking position, a coupling portion between the first coupling portion and the second coupling portion is located at a right side of the standard line.

4. The positioning structure of stapler handle of claim 1, wherein the buckle portion has an inclined face at a side thereof opposite to the base portion, the second coupling portion is selectively slidable along the inclined face.

5. The positioning structure of stapler handle of claim 1, wherein the buckle assembly further includes two connection portions, the two connection portions are connected to the two stopping arms and the first coupling portion respectively; the movement path includes a first section, when the buckle assembly moves from the locking position toward the release position along the first section, two body portions of the two pivot arms are located at the movement path of the two connection portions, the two connection portions push the two body portions to drive the at least one pivot portion to rotate with respect to the main body.

6. The positioning structure of stapler handle of claim 5, wherein the two pivot arms further include two head portions bending toward each other, the two head portions are connected to the two body portion respectively, the movement path further includes a second section connected to the first section; when the buckle assembly moves into the second section from the first section, the two head portions are located at the movement path of the base portion, the base portion pushes the two head portions to drive the at least one pivot portion to rotate with respect to the main body continuously.

7. The positioning structure of stapler handle of claim 6, wherein the buckle member is adapted for being pivotally connected to the main body and is rotatable about an axis; when observing along an extension direction of the axis, a standard line is defined perpendicular to a horizontal plane and passes through the axis; when the buckle member is located at the locking position, a coupling portion between the first coupling portion and the second coupling portion is located at a right side of the standard line; the buckle portion has an inclined face at a side thereof opposite to the base portion, the second coupling portion is selectively slidable along the inclined face; the positioning structure of stapler handle further includes a positioning assembly for being connected to the main body, when the second coupling portion is released from the first coupling portion, the buckle member is able to be selectively coupled with the positioning assembly; the buckle member encloses a restriction space, when the buckle member is located at the locking position, the buckle assembly penetrates the restriction space to move along the movement path; the first coupling portion is hook-shaped; the positioning assembly includes two protrusions facing each other and arranged spacedly, the two protrusions are able to selectively block the buckle member interferentially; an angle of pivoting of the buckle member between the release position and the locking position is smaller to 90 degrees; the buckle member is integrally form by bending a rod; the second coupling portion is a straight rod, a first length is defined as a length of the second coupling portion, each of the body portions includes a straight section and a bending section connected together, the straight section is connected to the head portion, the bending section is connected to the second coupling portion, a second length is defined as a length of the straight section, a third length is defined as a length of each of the head portions along a direction perpendicular to the axis, the first length is larger than each of the second length and the third length, the second length is smaller than each of the first length and the third length, a ratio of the first length to the second length is ranged 1.6-2.1, a ratio of the first length to the third length is ranged 1.3-1.7; a fourth length is defined as a minimum distance between the two head portions, the fourth length is smaller than the first length, a width of the base portion is smaller than the first length but larger than the fourth length; the pushing unit includes the two connection portions and the base portion; the pushed unit includes the two body portions and the two head portions; the at least one pivot portion includes two said pivot portions, the two pivot portions are adapted for being rotatably inserted into the main body.

8. The positioning structure of stapler handle of claim 1, further including a positioning assembly for being connected to the main body, when the second coupling portion is released from the first coupling portion, the buckle member being able to be selectively coupled with the positioning assembly.

9. The positioning structure of stapler handle of claim 1, wherein the buckle member encloses a restriction space, when the buckle member is located at the locking position, the buckle assembly penetrates the restriction space to move along the movement path.

* * * * *